US006718885B1

(12) United States Patent
Risser et al.

(10) Patent No.: US 6,718,885 B1
(45) Date of Patent: Apr. 13, 2004

(54) TROLLEY WITH TRACTOR DRIVE FOR USE IN CURVED ENCLOSED TRACKS AND SYSTEM INCLUDING THE SAME

(75) Inventors: Philip E. Risser, Leola, PA (US); Jeffrey M. Lesoine, Shillington, PA (US)

(73) Assignee: Transol Corporation, Morgantown, PA (US)

( * ) Notice: Subject to any disclaimer, the term of this patent is extended or adjusted under 35 U.S.C. 154(b) by 0 days.

(21) Appl. No.: 10/376,739

(22) Filed: Feb. 28, 2003

(51) Int. Cl.[7] ..... B61B 3/00

(52) U.S. Cl. ..... 105/30; 105/148; 105/155; 104/139

(58) Field of Search ..... 105/30, 31, 32, 105/148, 150, 153, 154, 155; 104/89, 93, 94, 95, 139, 140; 191/23 R, 23 A

(56) References Cited

U.S. PATENT DOCUMENTS 2,710,319 A * 6/1955 Bush ..... 200/61.44
3,518,947 A * 7/1970 Borst ..... 105/30
3,589,503 A 6/1971 Leach
3,627,595 A 12/1971 Leach
3,774,548 A * 11/1973 Borst ..... 105/30
3,855,941 A * 12/1974 Fromme et al. ..... 105/150
5,092,249 A * 3/1992 Knuettel ..... 105/30
6,178,891 B1 * 1/2001 Ostholt et al. ..... 104/93
6,450,326 B1 9/2002 Hoffmann et al.

* cited by examiner

*Primary Examiner*—Mark T. Le
(74) *Attorney, Agent, or Firm*—Caesar, Rivise, Bernstein, Cohen & Pokotilow, Ltd.

(57) ABSTRACT

An enclosed track system comprising an enclosed track having at least one curved portion and a trolley including a rolling section having first and second roller portions located within the track and spaced from each other and an externally located drive section. The second roller portion comprises a drive wheel arranged to roll on an inner surface of the track. The drive section has an articulated joint coupling the first and second roller portions to each other. The drive section includes a motor to cause the drive wheel to rotate, whereupon the trolley rolls along the track, with the articulated joint enabling the first and second roller portions to pivot longitudinally with respect to each other so that the trolley can negotiate curves in the track.

18 Claims, 3 Drawing Sheets

3
3
4
4

TROLLEY WITH TRACTOR DRIVE FOR USE IN CURVED ENCLOSED TRACKS AND SYSTEM INCLUDING THE SAME

FIELD OF THE INVENTION

This invention relates to generally to overhead conveyor systems and more particularly to systems making use of an enclosed track in which a trolley is arranged to roll to support something from the trolley

BACKGROUND OF THE INVENTION

Enclosed track conveyor systems are commonly used to support and carry items from a wheeled trolley located within the interior of an enclosed track. As is known enclosed tracks are hollow members having a top-wall, a pair of side walls projecting downward from the top wall and a pair of marginal flanges extending horizontally from respective ones of the side walls. The flanges are spaced from each other to form a slot therebetween. The trolley is located within the interior of the track, with its wheels or rollers disposed on the interior (upper) surface of the flanges.

Examples of enclosed track systems including internally located trolleys for rolling down the interior of the track are found in U.S. Pat. No. 3,589,503 (Leach), U.S. Pat. No. 3,627,595 (Leach) and U.S. Pat. No. 6,450,326 (Hoffmann et al.). The trolleys of the foregoing patents are arranged so that they can negotiate curves in the track.

In some prior art system, the movement or rolling of a trolley down the interior of an enclose track is accomplished by use a tractor drive that is mounted on the trolley, but located outside of the track. Such tractor drives make use of a drive wheel which extends through the slot in the track to frictionally engage the inner surface of the top wall of the track. The drive wheel is rotated by a motor mounted on the externally located tractor. This arrangement requires that the drive wheel be of a relative large diameter. As a result such tractors are not suitable for use in systems wherein the enclosed track includes a relatively small radius curve, since the drive wheel would engage or bind in the slot. While some enclosed track systems make use of tractors having drive wheels that engage and ride on the bottom of the track, i.e., the inner surface of one or more of the flanges, such systems are not practical due to splices used on the track, which results in an uneven drive surface, and make it difficult to keep a constant pressure on the drive wheel.

Thus, the design of existing hoist trolley drives makes it impractical to drive a trolley through a curve in an enclosed track system and a need exists for an enclosed track system which achieves that end.

SUMMARY OF THE INVENTION

This invention entails an enclosed track system comprising an enclosed track having at least one curved portion and a trolley arranged to roll within the interior of the enclosed track. The enclosed track is an elongated hollow member having a top wall portion, a pair of side wall portions and a pair of flanged portions. The flanged portions are spaced from each other to define a slot therebetween extending longitudinally along the track. The trolley comprises a rolling section and a drive section.

The rolling section comprises first and second roller portions. The first roller portion is located within the track and comprises at least one support roller arranged to roll on at least one of the flange portions of the track. The second roller portion is located within the track and comprises a drive wheel arranged to roll on the top wall portion of the track. The second roller portion is spaced longitudinally from the first roller portion. The drive section is located outside of the track and includes an articulated joint coupling the first roller portion to the second roller portion. The drive section is arranged to cause the drive wheel to rotate and roll along the top wall portion of the track, whereupon the drive wheel causes the trolley to move along the track. The articulated joint enables the first roller portion to pivot longitudinally with respect to the second roller portion to enable the trolley to negotiate curves in the track.

DETAILED DESCRIPTION OF THE PREFERRED EMBODIMENT

Figure 1:
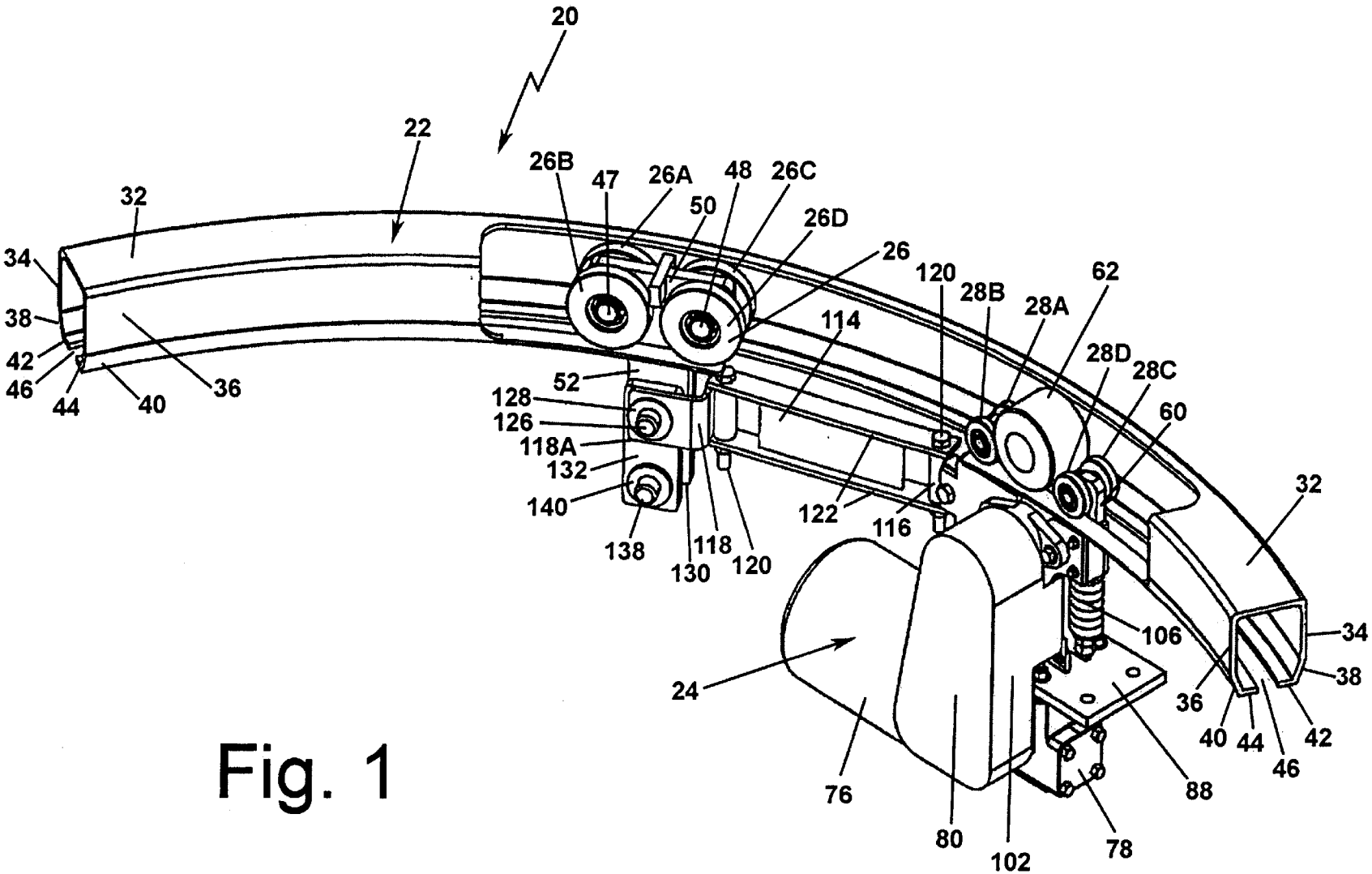
FIG. 1 is an isometric view, partially in section, of a portion of an enclosed track system making use of a trolley constructed in accordance with this invention shown in the process of negotiating a curve in the enclosed track.

In FIG. 1 there is shown at 20 one exemplary embodiment of an enclosed track system 20 constructed in accordance with this invention. The system 20 includes a conventional enclosed track 22 and a tractor-drive trolley 24. The details of the trolley 24 will be described later. Suffice it for now to state that the trolley 24 includes two internal roller sections 26 and 28 arranged to be located within the track 22, and an articulated externally located tow-arm assembly 30. The tow-arm assembly 30 is located outside of, i.e., below, the track 22 and is coupled to the both internal roller sections for moving the trolley along the track.

Figure 5:
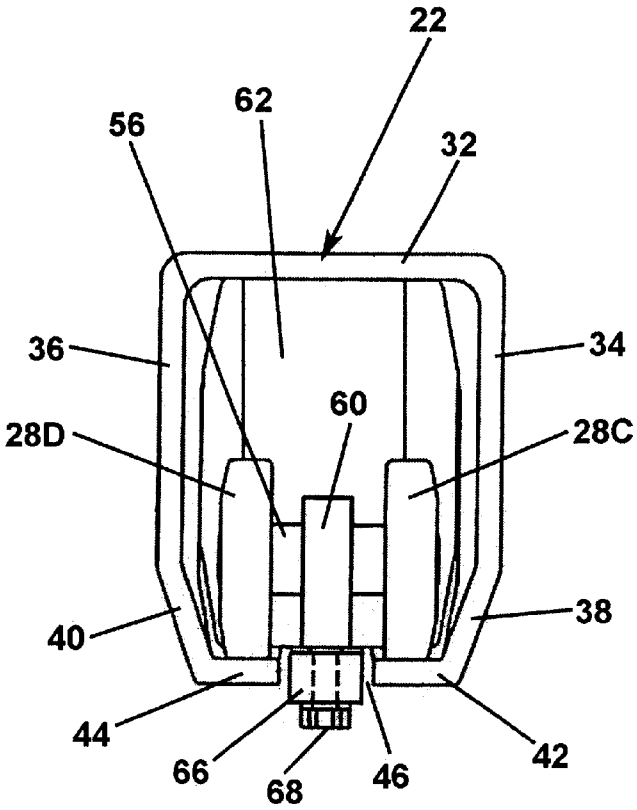
FIG. 5 is an enlarged sectional view of a portion of the track and trolley shown in FIG. 3.

Turning now to FIGS. 1 and 5 the track 22, the details of the track 22 will now be discussed. As can be seen the track is of the conventional "enclosed-type" construction. One particularly suitable enclosed track is that sold by SPANCO, a division of Transol Corporation, the assignee of this invention. The track 22 is an elongated member that can be linear or curved or both linear and curved, i.e., having at least one linear portion and at least one curved portion. In the exemplary system 20, the portion of the track 22 that is shown in FIG. 1 is curved. Other portions of the track 22 of the system 20 can be linear or curved, depending upon the application for the system. The track is formed of a strong material, e.g., steel, and has a horizontally disposed top wall 32, a pair of vertical sidewalls 34 and 36 projecting downward from the top wall 32, a pair of angularly located sidewalls 38 and 40 located below the vertical sidewalls 34 and 36, respectively, and a pair of horizontally disposed flanges 42 and 44 projecting inward from the ends of the angularly located sidewalls 38 and 40, respectively, to form a slot 46 also used for axles therebetween.

The track 22 is arranged to support at least one trolley 24 to enable the trolley to be driven, i.e., moved, along the track to any desired longitudinal position. The trolley 24 may be used to support or hold some other device or member from it. For example, the trolley 24 can be used to support a lifting device (not shown), such as a winch or hoist or one end of a bridge member to form a bridge crane.

Figures 2, 3:
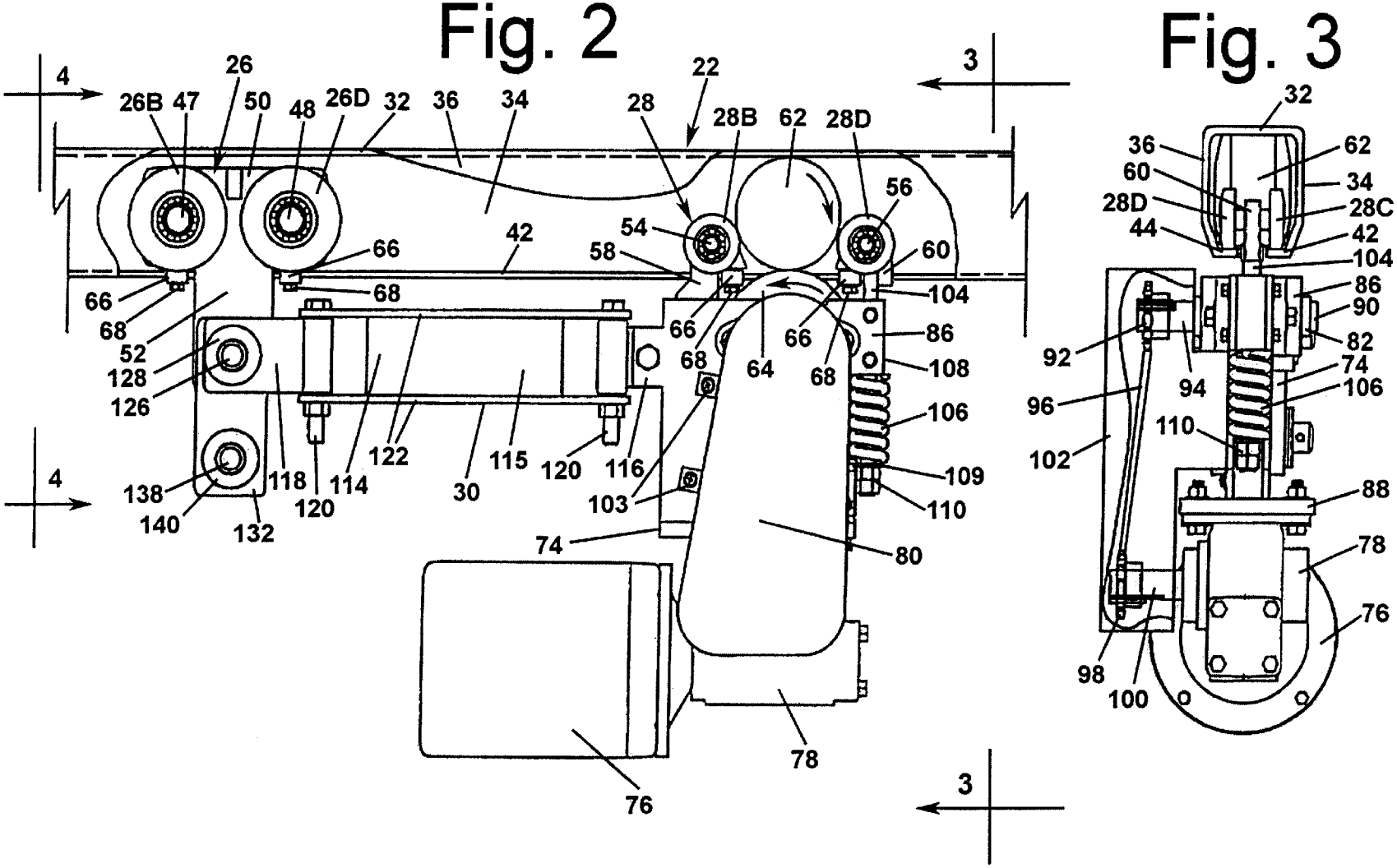
FIG. 2 is a side elevational view of the portion of the track and trolley shown in FIG. 1.
FIG. 3 is a sectional view of the track and trolley taken along line 3—3 of FIG. 2.

Turning now to FIGS. 1 and 2 the details of the trolley 24 will now be discussed. As can be seen the trolley 24, basically comprises the heretofore identified two internal roller sections 26 and 28 and the tow-arm assembly 30. The roller section 26 serves as the "front" roller section of the trolley 24 and includes two pairs of wheels or rollers located within the interior of the track 22. One pair of rollers is designated by the reference numbers 26A and 26B, while the other pair is designated by the reference numbers 26C and 26D. In accordance with one preferred embodiment of this invention the rollers are formed of a tough, wear resistant material, such as polyamide, but can be formed of any other material used in conventional enclosed track trolleys. As best seen in FIG. 1 the rollers 26A and 26B are mounted on an axle 47 and the rollers 26C and 26D are mounted on an axle 48. The rollers are held in place on their associated axles by use of conventional snap-rings. The axles 47 and 48 are fixedly mounted on a roller support body, in the form of a weldment, 50 so that the longitudinal axis of each axle extends perpendicularly to the plane of the roller support body 50 and to the longitudinal axis of the track 22. The axles 47 and 48 are spaced from each other longitudinally. The rollers 26A–26D are arranged so that the periphery of each roller engages and rolls along the interior surface of a respective flange 42 or 44 of the track 22. In particular, the rollers 26A and 26C are arranged to engage and roll on the inner surface of the flange 42 of the track 22, while the rollers 26B and 26D are arranged to engage and roll on the inner surface of the flange 44 of the track 22. The roller support body 50 also includes a downwardly depending plate-like portion 52 which extends through the slot 46 in the track. The plate-like portion 52 is pivotably coupled to a portion of the tow-arm assembly 30 (to be described later).

The roller section 28 serves as the "rear" roller section of the trolley 24 and also includes two pairs of wheels or rollers located within the interior of the track 22. One pair of rollers is designated by the reference numbers 28A and 28B, while the other pair is designated by the reference numbers 28C and 28D. The rollers 28A–28D are of similar construction to the rollers 26A–26D, but are smaller in diameter, for reasons to become apparent later. The rollers 28A and 28B are mounted on an axle 54 and the roller pair 26C and 26D are mounted on an axle 56. The axle 54 is mounted on a roller support body 58 (FIG. 2). The roller support body 58 is in the form of a plate-like member projecting upward from a portion of the externally located tractor 30 and extending through the slot 46 in the track 22. The axle 58 is mounted perpendicularly to the roller support body 58. The rollers 28A and 28B are dimensioned so that their peripheries engage and roll along the interior surface of flanges 42 or 44, respectively, of the track 22. The axle 56 is mounted on a roller support body 60 (FIG. 1). The roller support body 60 is in the form of a plate-like member. That member is mounted on a spring-biased rod (to be described later) forming another portion of the externally located tractor drive 30. A portion of the roller support body 60 extends through the slot 46 in the track 22. The rollers 28C and 28D are dimensioned so that their peripheries engage and roll along the interior surface of flanges 42 or 44, respectively, of the track 22.

The roller section 28 serves as the driving assembly of the trolley 24. In particular, section 28 includes a roller or wheel 62 which, as shown in FIGS. 1 and 2, is disposed between the pairs of rollers 28A, 28B and 28C, 28D. The wheel 62 is formed of polyamide, but can be formed of other suitable materials, if desired, and is in turn seated or disposed on a drive wheel 64 (FIG. 2) forming another portion of the tractor drive trolley 24. The wheel 62 is a passive device that is engaged and driven by the drive wheel 64. The drive wheel 64 is formed of steel or any other suitable material and is also located between the pairs of rollers 28A , 28B and 28C, 28D. The wheel 62 serves as a driven wheel of the trolley 24 and is held in position by the rollers 28A–28D and 62, so that it effectively "floats" on the drive wheel 64, i.e., its periphery frictionally engages the periphery of the drive wheel. In order to expedite the frictional engagement between the wheels 62 and 64, the outer periphery of the drive wheel 64 is knurled. When driven by the drive wheel 64 (as will be described later) the top portion of the periphery of the floating wheel 62 frictionally engages the inner surface of the top wall 32 of the track to cause the trolley to move longitudinally along the interior of the track. The drive wheel 64 forms a portion of the tractor drive trolley 24 and is a thin disk-like wheel having its top peripheral portion extending minimally through the slot 46 in the track. The drive wheel includes an axle fixedly secured thereto and located at the center of the wheel and having end portions projecting perpendicularly outward from the wheel and defining a rotation axis that extends perpendicularly to the longitudinal axis of the track 22. The axle of the drive wheel 64 is mounted within a pair of bearings on a frame portion of the tractor drive trolley 24 located outside, i.e., below, the track 22. The axle of the drive wheel 64 is coupled via a transmission to a motor forming another portion of the tractor drive trolley 24, so that upon operation of the motor the drive wheel 64 is rotated about an axis extending perpendicularly to the longitudinal axis of the track 22. This action causes the concomitant, albeit opposite, rotation of the floating wheel 62 about its axis, which is also perpendicular to the longitudinal axis of the track. The floating wheel 62 and the drive wheel 64 are dimensioned so that the top portion of the periphery of the floating wheel 62 frictionally engages the inner surface of the top wall 32 of the track, as shown in FIG. 2. The spring-biased rod mentioned earlier, and to be discussed later, helps ensure that the wheel 62 makes good frictional engagement with the interior surface of the top wall 32 of the track. Accordingly, when the drive wheel 64 is rotated by the motor, the floating or driven wheel 62 is rotated in the opposite rotational direction to frictionally engage the interior surface of the top wall 32 of the track 22 and hence push or pull (as the case may be - depending upon the direction of rotation of the wheel 62) the trolley along the track. In FIG. 2 the curved arrows represent the direction of rotation of the wheels 62 and 64 to cause the trolley to move in a forward direction along the track 22, i.e., the tractor drive pushes the trolley to the left in that figure. Rotation of the wheels 62 and 64 in the opposite directions causes the tractor drive to pull the trolley in the opposite longitudinal direction, i.e., rearwardly.

Figure 4:
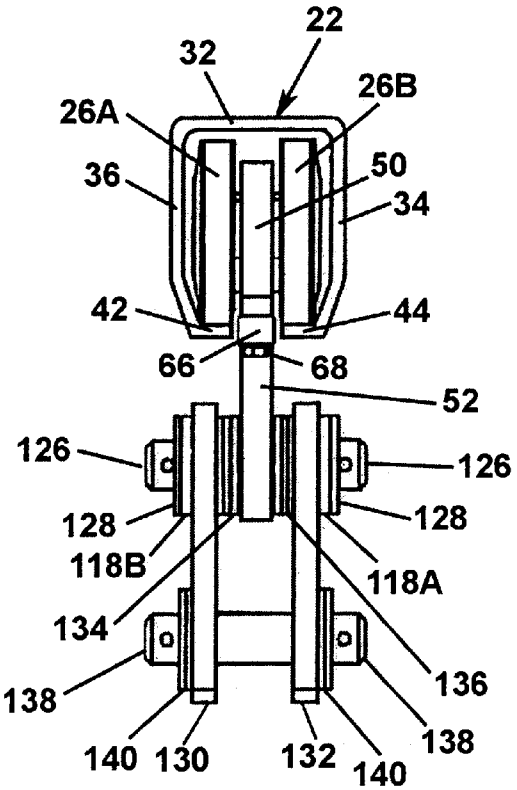
FIG. 4 is an enlarged sectional view of the track and a portion of the trolley taken along line 4—4 of FIG. 2.

In order to ensure that the portions of the tractor drive that extend through the slot 46 in the track 22 into its interior, e.g., the drive wheel 64 of the rear roller section 28 and the plate-like portion 52 of support body 50 of the front roller section 26, do not engage or bind on the edges of the slot 46 when the trolley moves along the track, each roller section 26 and 28 includes a pair of cam rollers to center the roller sections with respect to the track. In particular, as best seen in FIG. 5, a cam roller 66 is mounted on a vertically extending bolt 68 secured to the roller support body 60 of the rear roller section 28. The axis of rotation of the cam roller 66 is vertical and centered between the peripheral edges of the flanges 42 and 44 forming the track's slot 46. The diameter of the cam roller 66 is slightly smaller than the width of the track so that it can be centered therein. An identical cam roller 66 is mounted on a vertically extending bolt 68 secured to the roller support body 58 of the rear roller section 28. The axis of rotation of the cam roller 66 is vertical and centered between the peripheral edges of the flanges 42 and 44 forming the track's slot 46. As best seen in FIGS. 1 and 4, the front roller section 26 also includes cam rollers 66 and bolts 68, that are identical in construction to the cam rollers 66 and bolts 68, respectively, of the rear roller section 28. The cam rollers 66 are mounted via bolts 68 to the roller body 50 of the front roller section 26.

The tractor drive trolley 24 basically comprises a frame 74 (FIG. 2), the heretofore mentioned motor 76, a speed reducer 78, the heretofore mentioned transmission assembly 80, a drive wheel assembly 82 (FIG.3) including the heretofore identified drive roller 64, and a spring biasing assembly 84 including the heretofore mentioned spring-biased rod. The frame 74 is in the form of a weldment having a upper portion 86 supporting the drive wheel assembly 82, and a lower flange 88 (FIG. 3) mounting the speed reducer 78 and a portion of the transmission assembly 80. The speed reducer is secured to the flange 88 via plural bolts and nuts.

A pair of flanged bearings 90, forming a portion of the drive wheel assembly 82, are mounted on the upper portion 86 of the frame 74 and serve to journal respective portions of the axle of the drive wheel 64. As best seen in FIG. 3, a sprocket 92 is mounted on one end portion 94 of the axle of the drive wheel 64. The sprocket 92 forms a portion of the transmission assembly 80. That assembly also includes a drive chain 96 and another sprocket 98. The sprocket 98 is mounted on one end of an rotary output shaft 100 of the speed reducer 78. The drive chain 96 is a continuous chain in the form of a loop which extends about the sprockets 92 and 98. The speed reducer is a conventional device which is connected to the rotary output shaft of the motor 76 and includes gearing to reduce its rotary output shaft's rotational speed, e.g., 1,725 rpm, to a lower rotational speed, e.g., a 40 to 1 speed reduction, and to provide that at its output shaft 100. The rotation of the output shaft 100 of the speed reducer causes the concomitant rotation of the sprocket 98, which is coupled via the drive chain 86 to the sprocket 92 and to the axle 94 of the drive wheel 64 to cause it to rotate at the desired speed. It should be appreciated by those skilled in the art that the number of teeth on the two sprockets can be selected to provide a different rotational speed reduction, if desired. Moreover, the motor speed's and the amount of reduction of it by the speed reducer (or by the sprockets) is a matter of choice by the designer of the system.

In order to protect the drive chain and sprockets of the transmission assembly 80, a hollow housing or cover 102 is provided on the frame 74 and extends over the sprockets and the belt. The cover 102 is held in place on the frame 74 via plural screws and lock washers 103.

As mentioned earlier it is the frictional engagement and rotation of the floating wheel 62 on the inner surface of the top wall 32 of the track which effects the movement of the trolley 24 along the track. In order ensure that the driven or floating roller 64 makes good frictional engagement with the interior surface of the top wall 34 of the track 22 to effectively and efficiently move the trolley along the track without slippage, the heretofore spring biasing assembly 84 is provided. That assembly is mounted on the upper portion of the frame 74 and basically comprises the heretofore mentioned rod, now designated by the reference number 104 (FIG. 2), a helical compression spring 106 and an associated pair of nuts 110 and a flat washer 109. The rod 104 is an elongated member having an upper end to which the roller supporting body 60 is fixedly secured. The upper portion of the rod 104 extends through a bore in a projection 108 at the upper portion of the frame 74. The lower portion of the rod 104 extends out the bottom of the projection 108 and down through the longitudinal center of the spring 106 and out its lower end. The lower end of the rod is threaded. A flat washer 109 is mounted on the lower end of the rod 104 so that the spring 106 is interposed between it and the projection 108 of the upper portion of the frame 74. A pair of threaded nuts 110 are mounted on the lower threaded end of the rod to hold the washer 109 in place and to adjust the amount of compression applied to the spring 106 by the tightening of the nuts 110.

As should be appreciated by those skilled in the art, by tightening the nuts 110 on the rod 104, the spring 106 is compressed. The natural bias of the spring 106 tends to oppose this compression to thereby pull downward on the rod 104. This downward pulling of the rod 104 pulls the roller mounting body 60 and the rollers 28C and 28D mounted thereon downward. Since the rollers 28C and 28D are in engagement with the inner surfaces of the tracks flanges 42 and 44, this downward pull is resisted by the flanges and is translated into an upwardly directed force on the frame 74 and the drive roller assembly 90 carried thereby. Accordingly, an upward force is applied through the drive wheel 64 to the floating wheel 62 to force it into good frictional engagement with the inner surface of the top wall 32 of the track 22. Thus, when the driven roller 62 is driven by rotation of the drive roller 64, the driven roller 62 will roll on the inner surface of the top wall 32 of the track without slippage. This results in the movement of the trolley 24 down the track at a desired speed, e.g., 50 feet per minute using the exemplary rotational speeds of the shafts as discussed above.

In order to ensure that the two roller sections 26 and 28 can readily negotiate curves in the track 22, those roller sections are coupled together by a dual-hinged, articulated tow-arm assembly 30. To that end, as best seen in FIGS. 1 and 2, the tow-arm assembly 30 basically comprises a tow-arm member 114 and a pair of brackets 116 and 118. The bracket 116 is fixedly secured to a front edge portion of the frame 74 and includes a flanged bushing (to be described later). The bracket 118 also includes a flanged bushing (to be described later) and is in the form of a clevis that is secured to a portion of the plate-like member 52 of the roller support body 50 of the front roller section 26 (as will be described later with reference to FIG. 4). Respective pivot or hinge bolts 120 extend through respective ones of the flanged bushings making up brackets 116 and 118.

The tow-arm member 114 is a weldment in the form of an elongated plate-like member 115 having a pair of linear reinforcing webs 122 secured along the top and bottom edges of it. Each web 122 terminates beyond the associated end of the plate-like member 115 to form a gap therebetween in which a respective one of the flanged bushings of the brackets 116 and 118 is located. In particular, the pivot bolt 120 of the tow arm 114 closest to the frame 74 extends through aligned holes in the ends of the reinforcing webs 122 closest to the frame 74. That bolt also extends through the flange bushing making up the bracket 116 and includes a head on its upper end and a nut on its lower end to secure it to the tow-arm. Thus, the rear end of the tow-arm member 114 is hingedly secured to the frame 74 by the bolt 120 and its associated flanged bushing 116. In a similar manner the pivot bolt 120 of the tow-arm member closest to the plate-like member 52 of the support body 50 of the front roller section 26 extends through aligned holes in the ends of the reinforcing webs 122 closest to the plate-like member 52. That bolt also extends through the flange bushing making up the bracket 118 and also includes a head on its upper end and a nut on its lower end to secure it to the other end of the tow-arm member 114.

As best seen in FIG. 4, and as mentioned earlier, the front end portion of the bracket 118 is in the form of a clevis having a pair of spaced apart arms 118A and 118B. The plate-like member 52 of the front roller support body 50 is located between the arms 118A and 118B of the clevis and is secured in place via a pin 126 extending through it and through the arms of the clevis. The ends of the pin 126 are held in place by any conventional means, e.g., respective cotter pins (not shown) and associated flat washers 128. Thus, the front end of the tow-arm member 114 is hingedly secured to the plate-like member 52 by the bolt 120 and its associated flanged bushing 118. With this arrangement, the tow-arm assembly 30 can pivot independently with respect to the frame 74 carrying the rear roller section 28 and with respect to the roller support body 50 carrying the front roller section 26.

As best seen in FIGS. 2 and 4 a pair of hanger plates 130 and 132 forming a hoist hook bracket are suspended from the plate-like member 52. In particular, the hanger plate 130 is an elongated plate like member having a opening adjacent its upper end through which one end of the pin 126 extends. The hanger plate 130 is located between the plate-like member 52 and the washers 128 on one side of that member. A plurality of flat washers 134 are located between the hanger plate 130 and the plate-like member 52. The hanger plate 132 is identical in construction to the hanger plate 130 and also has a opening adjacent its upper end through which the other end of the pin 126 extends. The hanger plate 130 is located between the plate-like member 52 and the washers 128 on the opposite side of that member. A plurality of flat washers 136 are located between the hanger plate 132 and the plate-like member 52. The hanger plates 130 and 132 in turn serve to support a pin 138 which can support a hook, a hoist or any other member to be supported by the trolley 24. To that end each plate 130 and 132 includes a hole through which a respect portion of the pin 128 extends. Each end of the pin is secured in place via a cotter pin (not shown) and associated washers 140.

As should be appreciated by those skilled in the art from the foregoing, the system of the subject invention, and in particular its trolley, is particularly well suited for use in any enclosed track system, even those having relatively tight radius of curvature curves. The trolley 24 can be constructed in various ways and need not include all of the rollers shown and described heretofore. Moreover, other arrangements than that specifically described above can be used to effect the driving or movement of the trolley along the track by means of some motor located outside the track. Further still, this system is not limited to use with powered trolleys. Thus, the trolley of this invention can be a passive one that is pulled along the track by hand or by some other mechanism located below the track.

Without further elaboration the foregoing will so fully illustrate my invention that others may, by applying current or future knowledge, adopt the same for use under various conditions of service.

What is claimed is:

1. A trolley for use with an enclosed track having at least one curved portion, the enclosed track being an elongated hollow member having a top wall portion, a pair of side wall portions and a pair of flanged portions, the flanged portions are spaced from each other to define a slot therebetween extending longitudinally along the track, said trolley comprising a rolling section and a drive section, said rolling section comprising first and second roller portions, said first roller portion being located within the track and comprising at least one support roller arranged to roll on at least one of the flange portions of the track, said second roller portion being located within the track and comprising a drive wheel arranged to roll on the top wall portion of the track, said second roller portion being spaced longitudinally from said first roller portion, said drive section being located outside of said track and including an articulated joint coupling said first roller portion to said second roller portion, said drive section being arranged to cause said drive wheel to rotate and roll along the top wall portion of the track, whereupon said drive wheel causes said trolley to move along the track, said articulated joint enabling said first roller portion to pivot longitudinally with respect to said second roller portion to enable said trolley to negotiate curves in the track.

2. The trolley of claim 1 wherein said drive section includes a motor coupled through said slot in the track to said drive wheel.

3. The trolley of claim 2 wherein said drive section includes a driving wheel having a peripheral portion extending through the slot in the track, for engaging said drive wheel to cause said drive wheel to rotate.

4. The trolley of claim 3 wherein said second roller portion includes at least one roller arranged to roll on at least one of the flange portions of the track.

5. The trolley of claim 3 wherein said second roller portion includes a pair of support rollers longitudinally spaced from each other adjacent respective portions of the periphery of said driving wheel to form a pocket in which said drive wheel is located, said drive wheel being supported by said support rollers and said driving wheel.

6. The trolley of claim 3 additionally comprising an assembly to provide a bias force to cause said drive wheel to engage the top wall portion of the track.

7. The trolley of claim 6 wherein said assembly comprises a compression spring.

8. The trolley of claim 5 additionally comprising an assembly to provide a bias force to cause said drive wheel to engage the top wall portion of the track.

9. The trolley of claim 8 wherein said assembly comprises a compression spring.

10. In combination a trolley and an enclosed track having at least one curved portion, said enclosed track being an elongated hollow member having a top wall portion, a pair of side wall portions and a pair of flanged portions, said flanged portions are spaced from each other to define a slot therebetween extending longitudinally along said track, said trolley comprising a rolling section and a drive section, said rolling section comprising first and second roller portions, said first roller portion being located within said track and comprising at least one support roller arranged to roll on at least one of said flange portions of said track, said second roller portion being located within said track and comprising a drive wheel arranged to roll on said top wall portion of said track, said second roller portion being spaced longitudinally from said first roller portion, said drive section being located outside of said track and including an articulated joint coupling said first roller portion to said second roller portion, said drive section being arranged to cause said drive wheel to rotate and roll along said top wall portion of said track, whereupon said drive wheel causes said trolley to move along said track, said articulated joint enabling said first roller portion to pivot longitudinally with respect to said second roller portion to enable said trolley to negotiate curves in said track.

11. The combination of claim 10 wherein said drive section includes a motor coupled through said slot in the track to said drive wheel.

12. The combination of claim 11 wherein said drive section includes a driving wheel having a peripheral portion extending through the slot in the track, for engaging said drive wheel to cause said drive wheel to rotate.

13. The combination of claim 12 wherein said second roller portion includes at least one support roller arranged to roll on at least one of the flange portions of the track.

14. The combination of claim 13 wherein said second roller portion includes a pair of support rollers longitudinally spaced from each other adjacent respective portions of the periphery of said driving wheel to form a pocket in which said drive wheel is located, said drive wheel being supported by said support rollers and said driving wheel.

15. The combination of claim 12 additionally comprising an assembly to provide a bias force to cause said drive wheel to engage the top wall portion of the track.

16. The combination of claim 15 wherein said assembly comprises a compression spring.

17. The combination of claim 14 additionally comprising an assembly to provide a bias force to cause said drive wheel to engage the top wall portion of the track.

18. The combination of claim 17 wherein said assembly comprises a compression spring.

* * * * *